US009650921B2

(12) United States Patent
Nielsen et al.

(10) Patent No.: US 9,650,921 B2
(45) Date of Patent: May 16, 2017

(54) CENTRIFUGAL PROCESS TO ELIMINATE AIR IN HIGH PRESSURE CHAMBER OF HYDRAULIC LASH ADJUSTER

(71) Applicant: Eaton Corporation, Cleveland, OH (US)

(72) Inventors: Douglas John Nielsen, Marshall, MI (US); David Gerard Genise, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 105 days.

(21) Appl. No.: 14/764,686

(22) PCT Filed: Jan. 30, 2014

(86) PCT No.: PCT/US2014/013898

§ 371 (c)(1),
(2) Date: Jul. 30, 2015

(87) PCT Pub. No.: WO2014/123755

PCT Pub. Date: Aug. 14, 2014

(65) Prior Publication Data

US 2015/0369087 A1 Dec. 24, 2015

Related U.S. Application Data

(60) Provisional application No. 61/759,080, filed on Jan. 31, 2013.

(51) Int. Cl.
*F01L 1/24* (2006.01)
*F01L 1/25* (2006.01)

(52) U.S. Cl.
CPC ..... *F01L 1/24* (2013.01); *F01L 1/2405* (2013.01); *F01L 1/2416* (2013.01); *F01L 1/25* (2013.01); *F01L 2001/2444* (2013.01)

(58) Field of Classification Search
CPC ..... F01L 1/24; F01L 1/2405; F01L 1/2416; F01L 1/25; F01L 2001/2444
USPC ..... 141/1, 34; 184/6.24, 43, 70, 77
See application file for complete search history.

(56) References Cited

U.S. PATENT DOCUMENTS 3,786,792 A * 1/1974 Pelizzoni ..... F01L 1/2422 123/321
4,098,240 A * 7/1978 Abell, Jr. ..... F01L 1/2405 123/90.35
4,463,714 A * 8/1984 Nakamura ..... F01L 1/24 123/90.46

(Continued)

OTHER PUBLICATIONS

Trudell, D. B. et al., "Switching Roller Finger Follower Meets Lifetime Passenger Car Durability Requirements," SAE International, Sep. 10, 2012, pp. 1-14, publication No. 2012-01-1640.

*Primary Examiner* — Timothy L Maust
*Assistant Examiner* — Andrew Schmid
(74) *Attorney, Agent, or Firm* — Mei & Mark LLP

(57) ABSTRACT

A method for adding fluid to an hydraulic lash adjuster (HLA) comprises the steps of placing the HLA in to a centrifuge, the centrifuge having a fluid container, placing a sufficient amount of a first fluid in the fluid container to fluidly communicate with at least one fluid port of the HLA, and spinning the HLA at a first speed sufficient to move the first fluid in to at least the second of two fluid chambers in the HLA.

20 Claims, 11 Drawing Sheets

(56) References Cited

U.S. PATENT DOCUMENTS 4,584,976 A * 4/1986 Hillebrand ..... F01L 1/181 123/90.27
4,596,213 A * 6/1986 Hillebrand ..... F01L 1/2405 123/90.37
4,756,282 A * 7/1988 Kunz ..... F01L 1/25 123/90.55
5,129,373 A * 7/1992 Cuatt ..... F01L 1/2405 123/90.46
5,303,680 A * 4/1994 Nielsen ..... F01L 1/181 123/90.22
5,325,825 A * 7/1994 Schmidt ..... F01L 1/181 123/90.36
5,353,756 A * 10/1994 Murata ..... F01L 1/267 123/90.16
5,615,647 A * 4/1997 Nielsen ..... F01L 1/185 123/198 F
5,660,153 A * 8/1997 Hampton ..... F01L 1/185 123/198 F
5,704,316 A * 1/1998 Fujimoto ..... F01L 1/34409 123/90.17
5,855,191 A * 1/1999 Blowers ..... F01L 1/245 123/90.35
5,862,784 A * 1/1999 Blowers ..... F01L 1/2405 123/90.35
6,039,017 A * 3/2000 Hendriksma ..... F01L 1/2405 123/90.19
6,598,571 B1 * 7/2003 Harimoto ..... F01L 1/18 123/90.25
7,117,833 B2 * 10/2006 Spath ..... F01L 1/146 123/90.16
7,464,678 B2 * 12/2008 Rozario ..... F01L 1/146 123/90.52
7,509,933 B2 * 3/2009 Dingle ..... F01L 1/181 123/90.39
7,559,301 B2 * 7/2009 Hathaway ..... F01L 1/146 123/90.45
7,921,823 B2 * 4/2011 Sailer ..... F01L 1/022 123/90.16
8,201,533 B2 6/2012 Fujii et al.
8,276,556 B2 * 10/2012 Knauf ..... F01L 1/053 123/90.16
8,534,182 B2 * 9/2013 Keller ..... F01L 9/02 123/90.12
9,016,252 B2 * 4/2015 Zurface ..... F01L 1/18 123/90.52
9,157,542 B2 * 10/2015 Beneker ..... F16K 11/048
9,333,847 B1 * 5/2016 Buffet ..... B60K 6/445
2003/0010305 A1 * 1/2003 Genise ..... F01L 1/182 123/90.45
2004/0244751 A1 * 12/2004 Falkowski ..... F01L 1/146 123/90.55
2005/0178350 A1 * 8/2005 Nakamura ..... F01L 1/2405 123/90.16
2005/0183686 A1 * 8/2005 Fujii ..... F01L 1/2405 123/90.58
2009/0020088 A1 * 1/2009 Fujii ..... F01L 1/2405 123/90.55
2009/0031976 A1 * 2/2009 Genise ..... F01L 1/245 123/90.46
2011/0226047 A1 * 9/2011 Stretch ..... G01L 9/0089 73/114.18
2013/0306013 A1 * 11/2013 Zurface ..... F01L 1/18 123/90.16
2013/0312506 A1 * 11/2013 Nielsen ..... F01L 1/185 73/114.79
2014/0116363 A1 * 5/2014 Stretch ..... F01L 1/24 123/90.12
2015/0053031 A1 * 2/2015 Willcox ..... F16H 1/20 74/409
2015/0369087 A1 * 12/2015 Nielsen ..... F01L 1/24 141/1
2016/0115830 A1 * 4/2016 Stretch ..... G01L 23/04 73/114.16
2016/0138484 A1 * 5/2016 Nielsen ..... F01L 3/08 73/114.79
2016/0319708 A1 * 11/2016 Nielsen ..... F01L 1/146
2016/0348673 A1 * 12/2016 Honda ..... F04C 14/226

* cited by examiner

CENTRIFUGAL PROCESS TO ELIMINATE AIR IN HIGH PRESSURE CHAMBER OF HYDRAULIC LASH ADJUSTER

This is a National Stage §371 application of Patent Cooperation Treaty Application No. PCT/US2014/013898, filed Jan. 30, 2014, which claims the benefit of priority of U.S. Provisional Patent Application 61/759,080, filed Jan. 31, 2013, both of which are incorporated herein by reference in their entireties.

TECHNICAL FIELD

The present disclosure relates generally to processes for manufacturing hydraulic lash adjusters (HLAs). More specifically, the disclosure relates to using a centrifuge to replace air in a high pressure chamber of the HLA with another fluid.

BACKGROUND

A hydraulic lash adjuster (HLA) typically comprises a chamber that should be filled with fluid so that the fluid can be compressed and thereby offset cam-related parameters in an engine valve train. The amount of fluid in the chamber can vary based on the moment of use of the HLA in the valve train cycle. That is, the fluid chamber can cyclically be in a compressed (high pressure) and uncompressed (ambient pressure) state and the fluid volume within the HLA may vary dependent upon the point in the cycle. Some HLAs are designed to pull oil in to a first chamber and allow leakdown of fluid out of the first chamber and in to a second chamber as the HLA cycles in the valve train. Some HLAs are designed so that, in use, the pressure differential between the first chamber and the second chamber selectively allows fluid communication between the chambers via a selective transfer mechanism. HLAs may additionally be designed to draw fluid from an external reservoir into the HLA to replenish the fluid within.

Oil is the preferred fluid for the first and second chambers during engine operation. However it is difficult to completely fill the chambers with oil prior to installing the HLA in a valve train. This difficulty is caused by several factors such as fluid viscosity, adhesion, manufacturing actions which result in "pump down" of the fluid, or other fluid motions due to the accommodations for leakdown or accommodations for communication with the reservoir. The difficulties can lead to air in one or both chambers instead of oil. Such an air-containing HLA can be referred to as "spongy" or "pumped down," and such an HLA may be rejected by end users.

It is important to adequately fill the HLA with the desired fluid prior to installing it in a valve train. This is because the HLA serves a protective function and accommodates variations in cam action or cam tolerances. Air in the chambers results in improper pressurization. The improper pressurization can mean that the HLA cannot satisfy its protective function, and serious engine damage may occur. This damage is especially true for an engine being operated for the first time, or for an engine in a calibration cycle.

SUMMARY

The present disclosure provides methods and an apparatus for eliminating air in the fluid chambers of an HLA. The resulting HLA is not "spongy" and can perform its protective function reliably, even upon first use in a valve train.

A method for adding fluid to an hydraulic lash adjuster (HLA) is disclosed herein. The HLA may comprise a housing, an inner plunger, a first fluid chamber, a second fluid chamber, a fluid passageway between the first fluid chamber and the second fluid chamber, and at least one fluid port in fluid communication with the first fluid chamber. The method may comprise placing the HLA in to a centrifuge, the centrifuge having a fluid container, placing a sufficient amount of a first fluid in the fluid container to fluidly communicate with the at least one fluid port, and spinning the HLA at a first speed sufficient to move the first fluid in to the second fluid chamber.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several explanations of the methods and apparatus disclosed herein.

DETAILED DESCRIPTION

Figure 1:
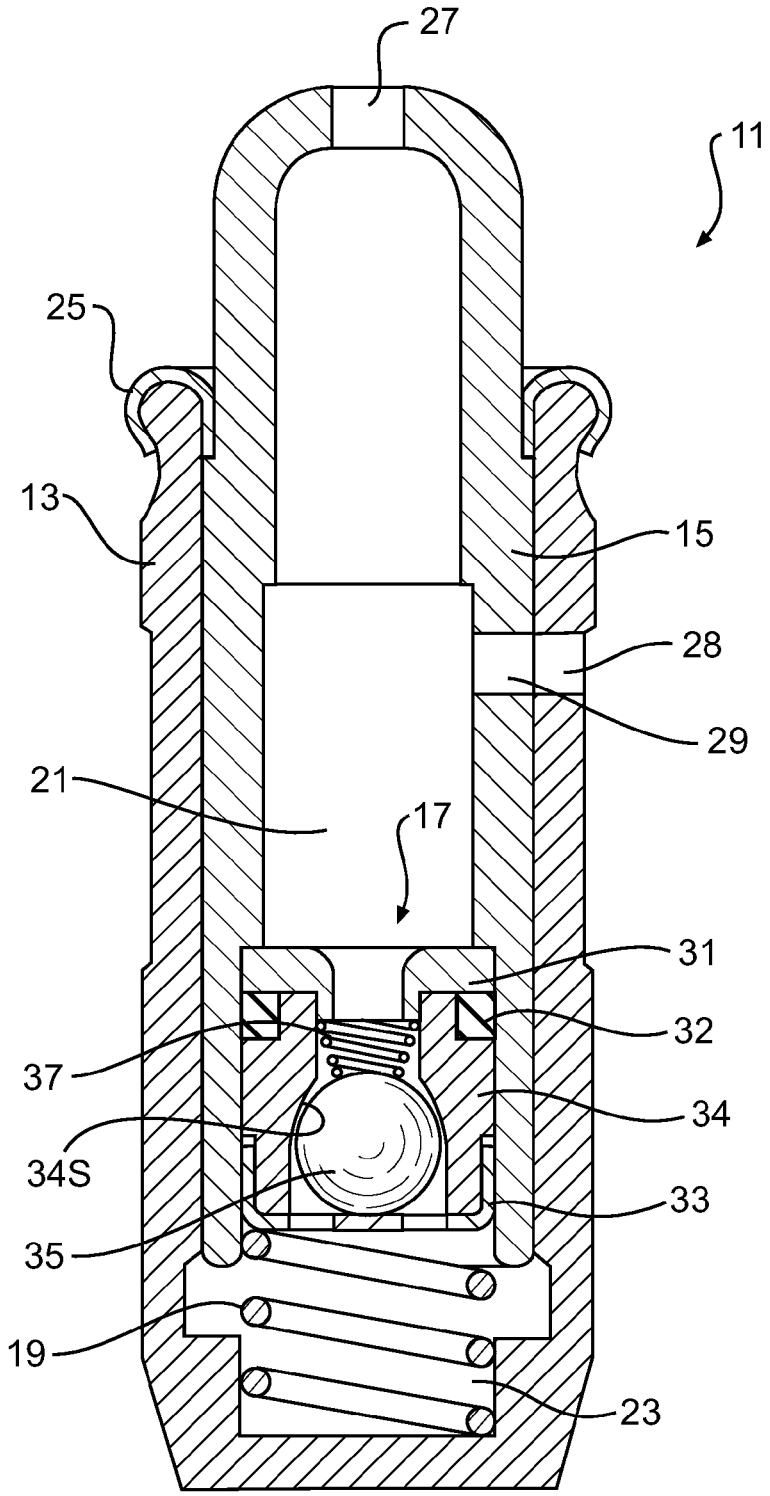
FIG. 1 is an example of a normally-biased open HLA.

Reference will now be made in detail to the present exemplary embodiments, examples of which are illustrated in the accompanying drawings. Wherever possible, the same reference numbers will be used throughout the drawings to refer to the same or like parts.

The disclosed methods and apparatus have broad applicability to many types and configurations of hydraulic lash adjusters ("HLAs"), which are sometimes referred to as tappets. For example, the method and centrifuge apparatus may be used with normally-open HLAs such as that shown in FIG. 1, normally-closed HLAs such as that shown in FIG. 2, "free ball" type HLAs, or the dual feed port HLA of FIG. 3. While the illustrations use check valves having spring-loaded check balls to regulate fluid flow, other check valves can be used with the methods and apparatus disclosed herein. For example, an alternative check valve may comprise a check element having a polygonal or other non spherical shape such as a check plate design having a flat plate movable to regulate fluid flow. The HLAs illustrated are not restrictive of the centrifuge apparatus or methods, but serve to explain general working principles. That is, there are modifications to accommodate a variety of HLAs for a variety of valve trains, such as overhead cam (OHC) or overhead valve (OHV) type engine valve trains. Various HLA parameters change to accommodate the valve train needs such as size, thickness, fluid type, fluid chamber size, fluid transfer design, spring constants, etc. That is, the HLA design is adjusted based on its application and the disclosed methods and centrifuge devices may be used with HLAs in addition to those illustrated so long as the HLA has compatible fluid passageways.

For example, as shown in FIGS. 4A-4E, the size, placement, actuation and other relationships to a valve and cam changes, but the HLAs share a common need for adequate fluid content to perform their function. Therefore, the disclosed methods and apparatus may be used with the exemplary HLAs of FIGS. 1-4E, such as the FIG. 4A type I direct acting overhead cam, the FIG. 4B type II end pivot overhead cam, the FIG. 4C type III center pivot overhead cam, the FIG. 4D type IV center pivot with follower overhead cam, or the FIG. 4E type V pushrod overhead valve. Cams 1A-1E attach to HLAs in locations 11A-11E and receive motive power via actuation attachments 3A-3E, respectively. Rocker arms 2B-2E may be included in the valve train assembly as needed.

Returning to FIG. 1, the example shows a normally-biased open HLA 11 having a housing or body 13, a plunger 15, a check valve assembly 17 (sometimes referred to as a cartridge), a plunger spring 19, a first fluid chamber 21 (also referred to as a reservoir), a second fluid chamber 23 (also referred to as a high pressure chamber), a cap member 25, an opening 27, a body fluid port 28, and a plunger fluid port 29. Opening 27 may be for a jiggle pin or other metering valve pin or opening 27 may serve another purpose.

Check valve assembly 17 comprises, in this example, a seat member 34 having an upper seal member 32 covered by an upper seat member 31. The check element is a check ball 35, which is pressed against a retainer 33 (also referred to as a cage) by a compression spring 37. In this normally-biased open state, fluid can pass between the first fluid chamber 21 and the second fluid chamber 23 when the device is in a neutral state, but in operation, fluid pressure may assist the check ball in overcoming the spring force of the compression spring 37 such that the check ball 35 rests against the inner seat surface 34S. In this latter state, fluid cannot pass between the first chamber 21 and the second chamber 23.

Also based on the operation state or stroke, the plunger 15 may be in an upward or downward position such that the body fluid port 28 comes in or out of alignment with the plunger fluid port 29, and the plunger spring 19 either pushes the plunger 15 upward or the plunger spring 19 is compressed by affiliated cam and or rocker arm operation. In the alternative, the plunger 15 may have a circumferential groove to allow the plunger fluid port 29 to maintain fluid communication with body fluid port 28, or the inner diameter of the body 13 may have a circumferential groove to maintain fluid communication between body fluid port 28 and plunger fluid port 29 regardless of whether the plunger is in its top-biased or bottomed-out position.

Figure 2:
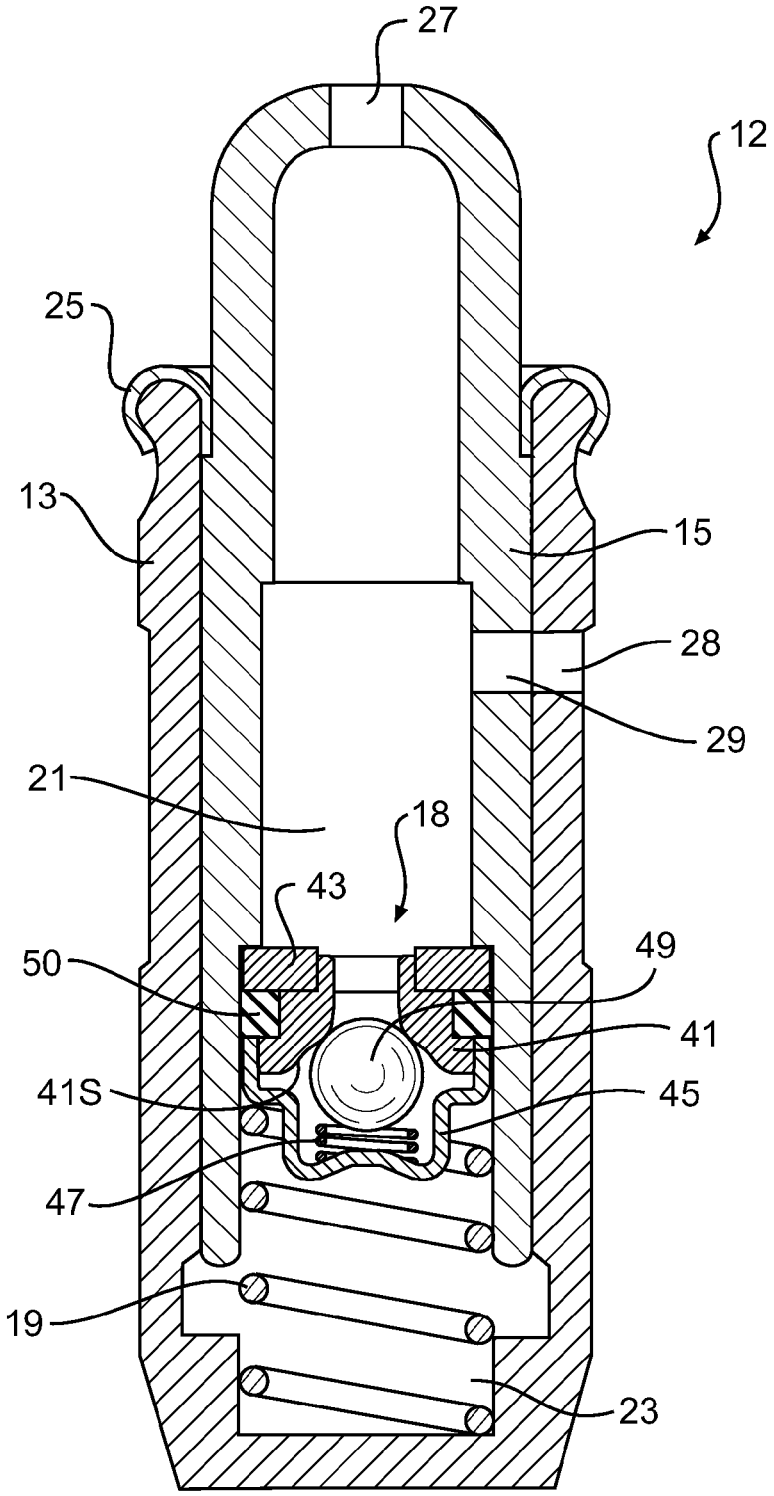
FIG. 2 is an example of a normally-biased closed HLA.

FIG. 2 is similar to FIG. 1 in many structural respects, but differs in that the check valve assembly is a normally-biased closed check valve assembly 18. A compression spring 47 presses against a retainer 45 to urge the check element, here a check ball 49, against an inner seat surface 41S of a seat member 41. A seal member 50 surrounds an upper portion of the seat member 41 and an upper seat member 43 abuts the seal member 50 and seat member 41.

The example of FIG. 2 shows that, dependent upon operation state, the check ball 49 inhibits fluid transfer between the first fluid chamber 21 and the second fluid chamber 23. A pressure differential can overcome the spring force of the compression spring 47 to displace the check ball 49 to allow free fluid communication between first and second fluid chambers. As above, the plunger may move up and down against a spring force of plunger spring 19, and the body fluid port 28 may come in and out of alignment with the plunger fluid port 29.

Figure 3:
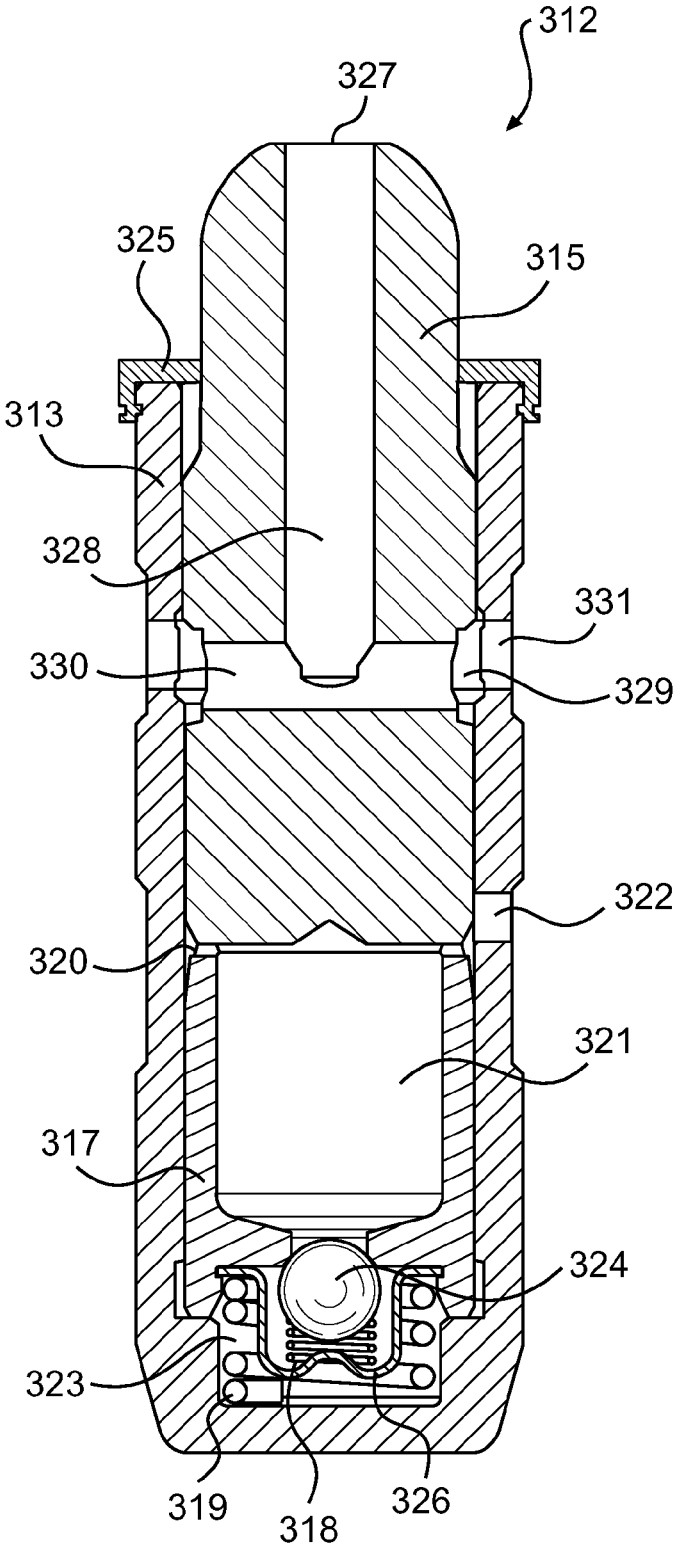
FIG. 3 is an example of an HLA having dual feed ports.
Figure 4C:
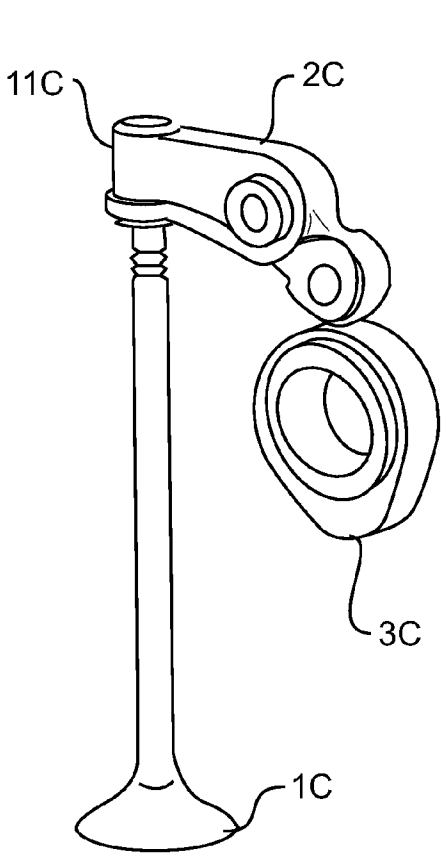
FIG. 4C illustrates an example of a type III center pivot overhead cam.
Figure 4B:
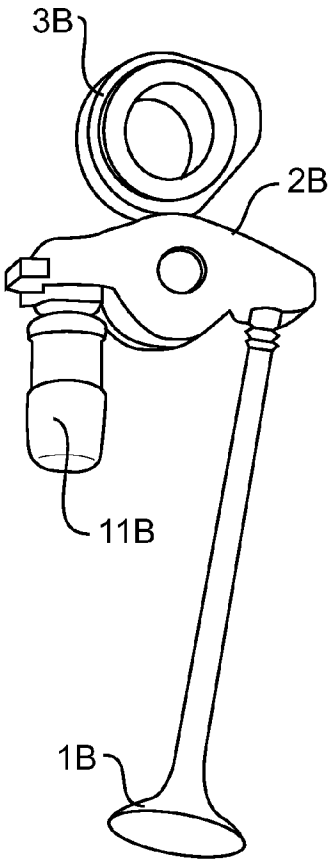
FIG. 4B illustrates an example of a type II end pivot overhead cam.
Figure 4A:
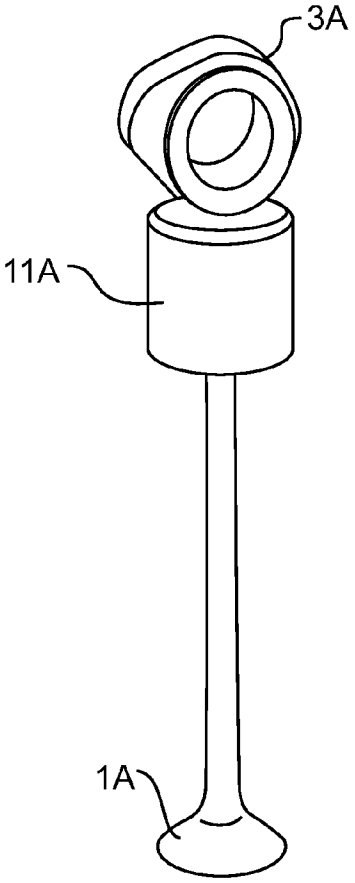
FIG. 4A illustrates an example of a type I direct acting overhead cam.
Figure 4E:
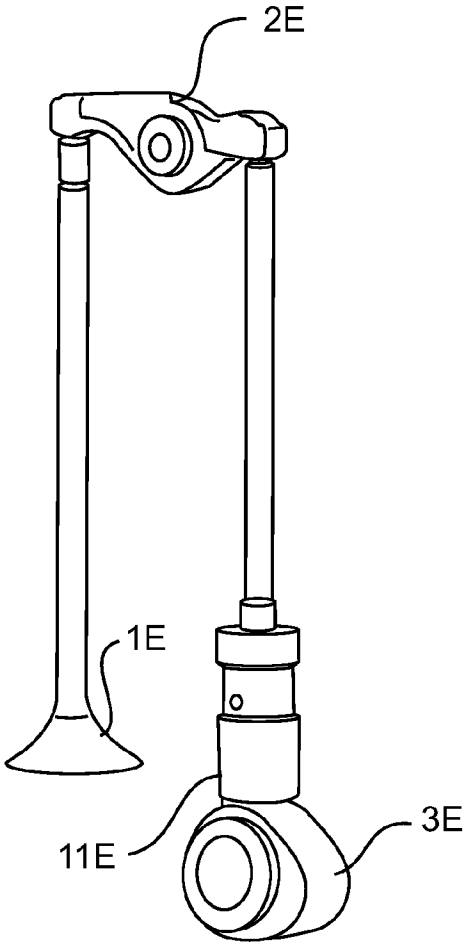
FIG. 4E illustrates an example of a type V pushrod overhead valve.
Figure 4D:
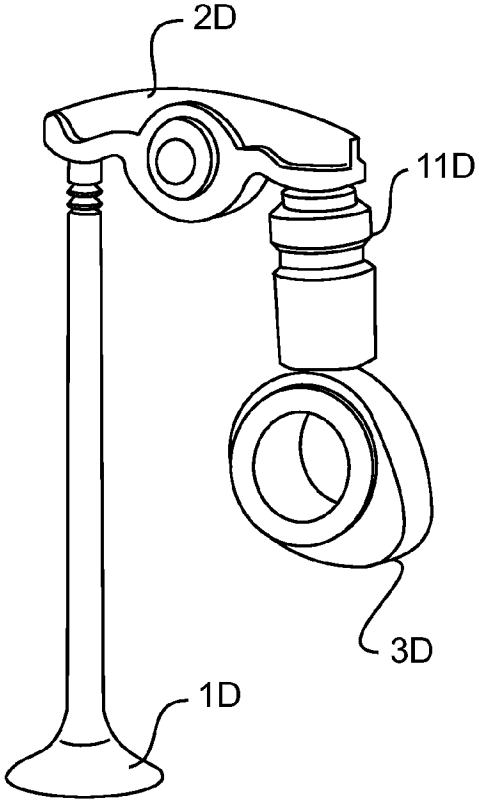
FIG. 4D illustrates an example of a type IV center pivot with follower overhead cam.

FIG. 3 shows another variation of an HLA having multiple fluid ports. Sometimes called a "dual feed" HLA 312, the exemplary lash adjuster has a housing or body 313 surrounding a plunger 315 and a sleeve 317. The HLA has an upper switching fluid port 331 and a lower first body fluid port 322 making up the dual feeds. The example of FIG. 3 also illustrates an example of a two piece plunger. The plunger 315 may be referred to as a "ball plunger" and the sleeve 317 may be referred to as a "leakdown plunger." And, in an alternative HLA, a two piece plunger may be used in place of the plungers 15 shown in FIGS. 1 and 2.

A plunger spring 319 pushes against a bottom surface of the body 313 to normally bias the sleeve 317 and plunger 315 upwards against a cap 325. However, FIG. 3 shows the HLA in a bottomed-out configuration with plunger spring 319 compressed.

FIG. 3 also illustrates circumferential grooves in both the plunger 315 and body 313 to enable fluid communication between cross portion 330 and switching fluid port 331. Likewise, circumferential grooves are on plunger 315 and sleeve 317 to enable continuous fluid communication between first body fluid port 322 and fluid passageway 320 as the plunger and sleeve move up and down.

A first, low pressure, chamber 321 is in fluid communication with fluid passageway 320, which is in fluid communication with a first body fluid port 322. Fluid in the first chamber 321 may enter the second, high pressure, chamber 323 when the normally-biased closed check ball 324 moves from a passageway between the first and second chambers. A check ball spring 318 biases the check ball 324 away from a cage 326 and against the sleeve 317.

A switching, or auxiliary, chamber 328 is in fluid communication with an opening 327 in the ball plunger 315 and a switching fluid port 331 in the body 313 and a switching fluid passageway 329 between the plunger 315 and the body 313. In this example, a cross portion 330 of the plunger 315 is cross-drilled so that the switching chamber 328 may be fed via two or more switching fluid ports 331 on either side of the cross portion 330. The ball plunger example of FIG. 3 ordinarily serves a fluid flow function through opening 327 and may or may not include a metering or jiggle pin.

As is customary, the HLAs 11, 12, and 312 may have fluid communication with fluid reservoirs in the valve train once the respective HLAs are installed. That is, parts such as first body fluid port 322, switching fluid ports 331, and body fluid ports 28, may have fluid communication with fluid reservoirs in the valve train.

Other variations of HLAs are compatible with the centrifuge method and apparatus disclosed herein. The other HLAs include "free ball" type having a check valve assembly where the check element is not spring loaded, but has a predetermined "play", or movement area. The HLA may also be formed such that portions of the check valve, such as the ball seat, are formed integrally in the plunger. Also included are HLAs having ports or passageways for "leakdown" of fluid. That is, the HLA may be modified to allow additional fluid communication between first and second chambers 21 and 23 such as by having grooves in the body 13 or plunger 15 along one or more interface areas therebetween. The HLA may have fewer or more body ports or plunger ports for fluid flow control. For example, a single body port may alternately feed one of two plunger ports as the plunger rises and falls in a pumping cycle. In addition, the HLAs may be fully assembled and have a motion-restrictive cap in place, such as caps 25 or 325, or the HLAs may be partially assembled when they are filled according to the disclosed methods and apparatus.

The HLA examples herein are not meant to be exhaustive. Instead, the examples of HLAs provide a basis for understanding the further disclosure regarding the methods and apparatus herein below. Numerous variations are compatible with the disclosed method and apparatus.

Figure 5B:
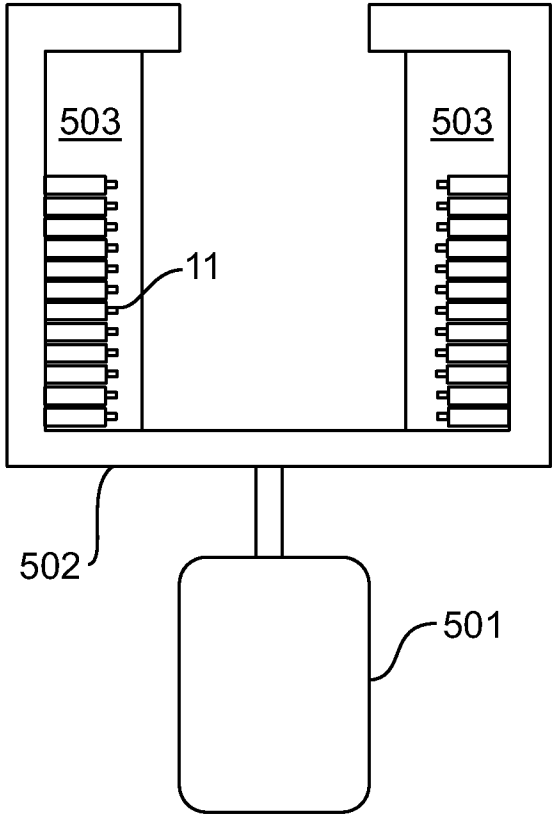
FIG. 5B is an example of a centrifuge in a spinning state.
Figure 5A:
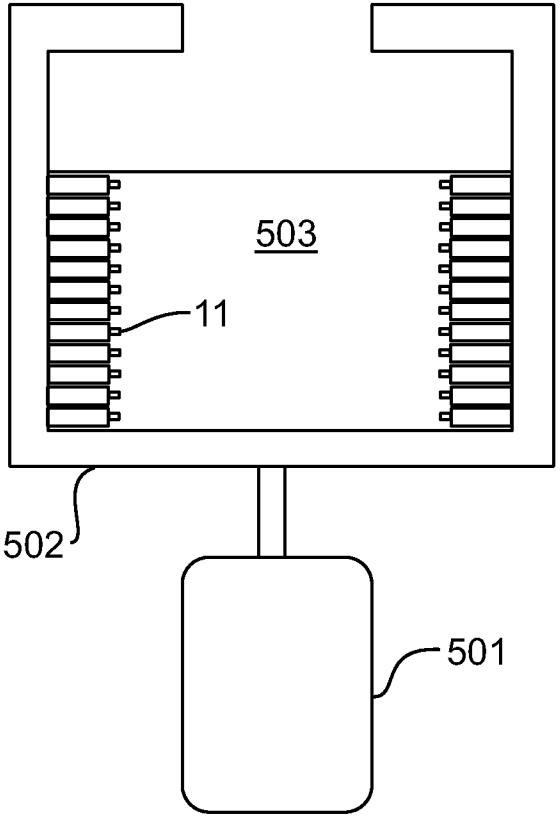
FIG. 5A is an example of a centrifuge in a static state.

Turning now to FIGS. 5A, 5B, 6A, and 6B, variations of a centrifuge apparatus are shown. A centrifuge in accordance with this disclosure is a machine using centrifugal force for separating substances of different densities, such as an apparatus consisting of a compartment spun about a central axis to separate contained materials of different specific gravities. In this disclosure, the centrifuge separates out air or another fluid and replaces that fluid with one having a desired viscosity and specific gravity. In FIGS. 5A and 5B, HLAs 11 are positioned into a fluid container such as drum 502 of a centrifuge device. The long axis of each HLA is parallel to the bottom of the drum and opening 27 opens towards the interior, or center, of the drum. Any affiliated jiggle pin or metering pin is facing interiorly, also. The orientation of the HLA aligns the preconfigured longitudinal axis of the components of the HLA approximately with the direction of the eventual centripetal force vector of the centrifuge mechanism. For example, check ball 49 can move along the long axis to open the check valve and the plunger 15 can move longitudinally and bottom out as the centrifuge spins.

The HLAs are covered with a fluid appropriate for the HLA application, such as an oil or leakdown fluid of preselected viscosity, or a mixture of the two. The drum is then spun via appropriate connections to a motor 501. As the rotations per minute (RPMs) increase, the fluid tends to move up the walls of the drum, as shown in FIG. 5B. The spinning also forces the fluid in to the first and second fluid chambers 21 and 23 and into leakdown and other fluid passageways. The motor 501 is selected to provide adequate RPMs (rotations per minute) with respect to the balance and dimensions of the drum to achieve the centrifugal and centripetal forces needed to move the fluid into the HLAs.

While the HLAs are shown stacked in the drum 502, the HLAs may be arranged in one or more cartridges or other organizing devices prior to spinning.

While fluid 503 is illustrated as covering HLAs 11 in both non-spinning (FIG. 5A) and spinning states (FIG. 5B), the size and/or configuration of the drum and/or HLAs may require a different fluid level. The amount of fluid in the drum can be selected so that it does not cover all of the HLAs in the non-spinning state, but the amount covers the HLAs during spinning.

Figure 6A:
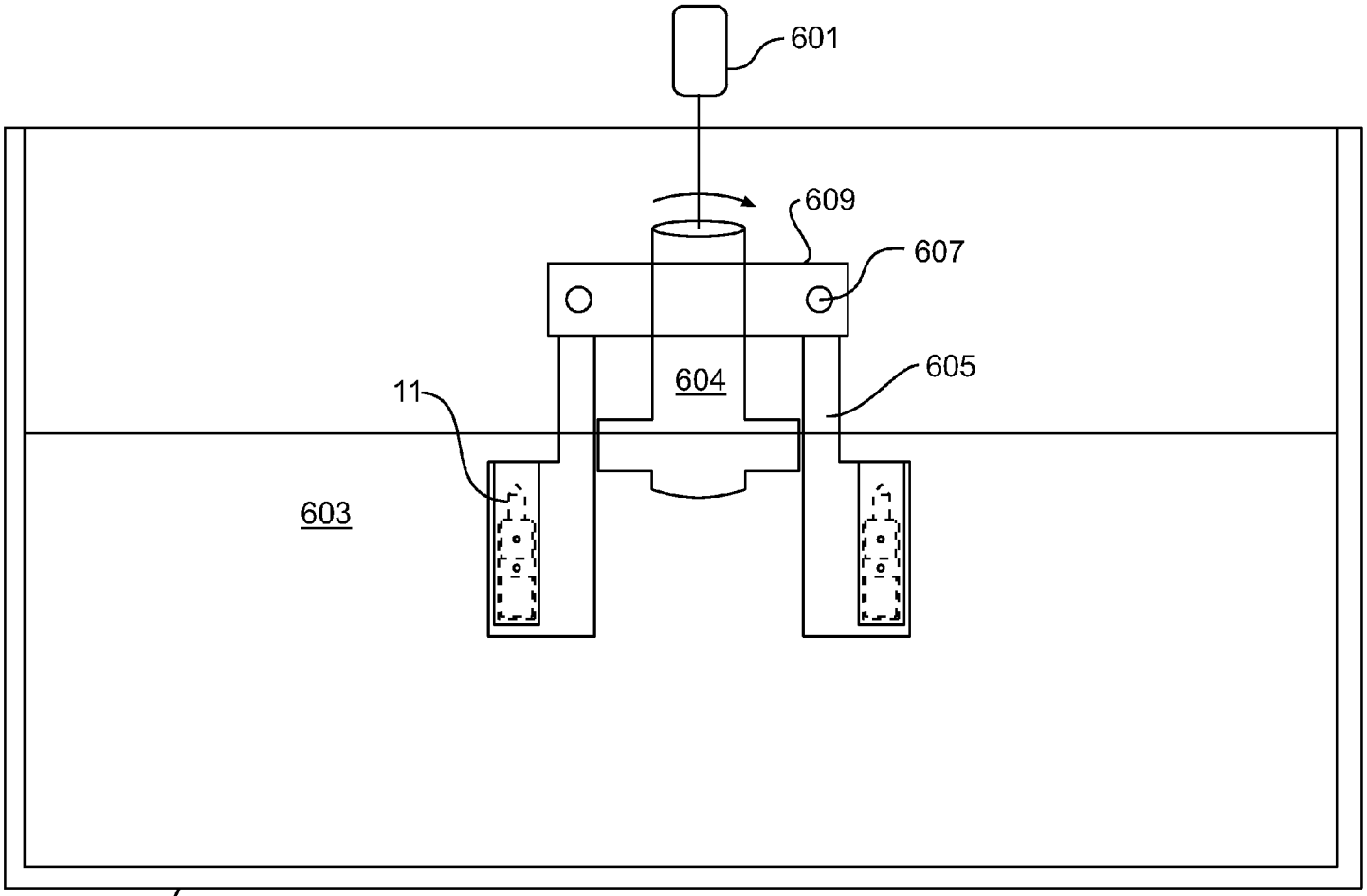
FIG. 6A is an example of a second centrifuge in a static state.
Figure 6B:
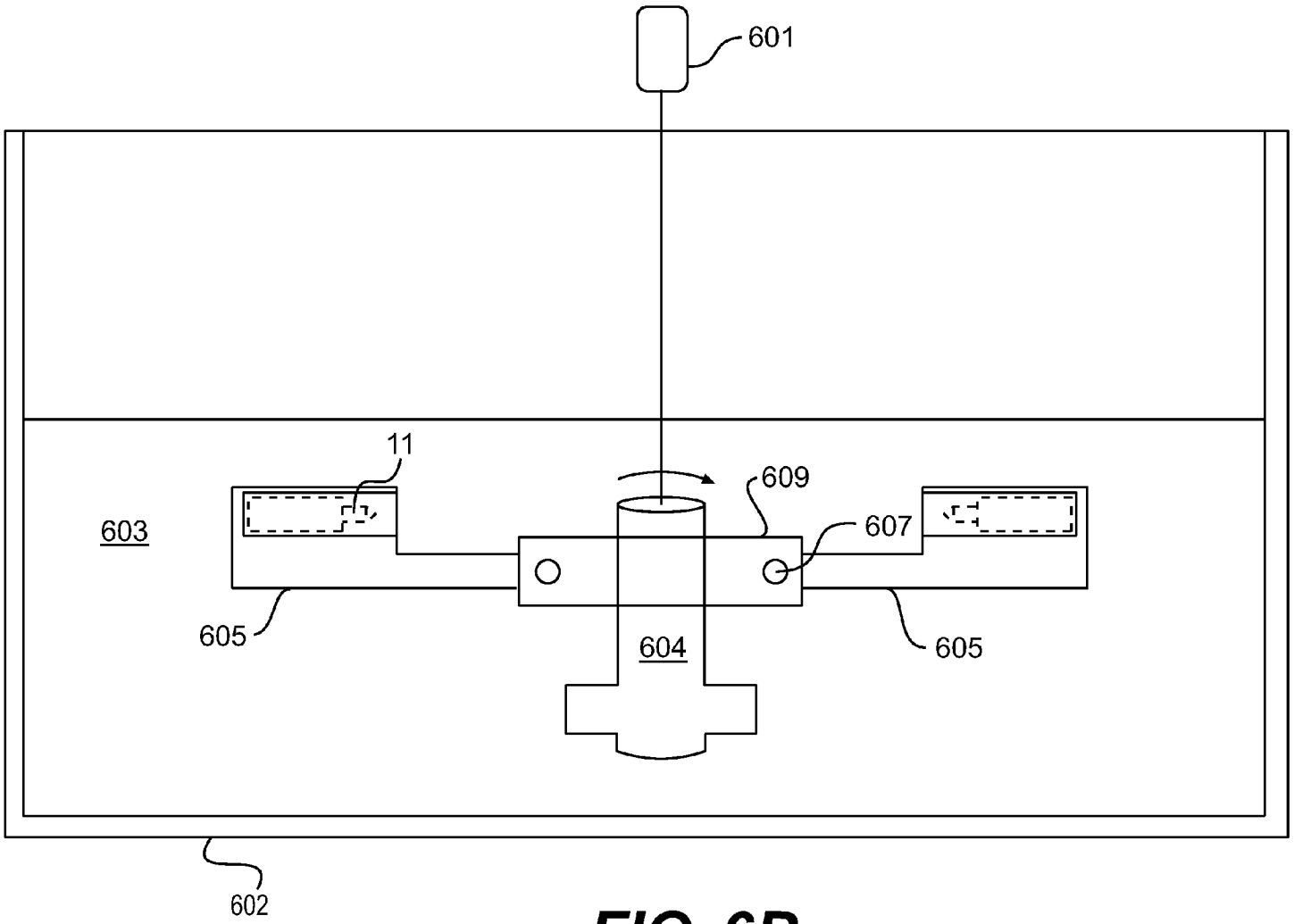
FIG. 6B is an example of the second centrifuge in a spinning state.

In FIGS. 6A and 6B, an alternative centrifuge apparatus includes a fluid container such as drum 602 containing a desired fluid 603 such as oil or leakdown fluid. The motor powers a rotor 604 to spin swinging buckets or paddles 605 that hold the HLAs 11, 12, or 312. As the RPMs increase, the paddles lift to the position shown in FIG. 6B. In this example, the paddles 605 are attached to pivot points 607 of a collar 609 mounted on the rotor 604. The paddles 605 hold the HLAs as they spin and may also hold ballast weights or the desired fluid 603.

HLAs 11 have their long axis oriented with the long axis of the paddles 605 so that at rest, opening 27 points out of the paddle in the direction of the pivot points 607.

The rotor may be lowered in to the drum 602 to keep the HLAs submerged, or the drum may be raised up to aid submersion. The raising or lowering may occur prior to, or contemporaneous with, the spinning of the HLAs. Alternatively, the drum 602 may have a sufficient depth to accommodate a fluid height that covers the HLAs 11 in the paddles 605 during static and spinning states. In another alternative, the paddles may be spun in the drum without fluid in the drum. This would require that the paddles also function as fluid containers. In the empty drum scenario, the HLA fluid containers in the paddles could be filled through a feed mechanism or as detailed below.

As above, in this example, the HLA is designed so that the check element and plunger move along the long axis of the HLA. However, it is possible to use other HLA designs, so long as the check element and/or plunger move in response to centripetal force. The HLAs are oriented in the centrifuge apparatus so that as the RPMs increase, the spring forces are overcome as needed and the desired fluid is forced throughout the HLA.

The RPMs of the centrifuge are selected so that the desired fluid pushes in to the HLA and forces any air within the HLA out. This eliminates air in the HLA and effectively "pumps up" the HLA. The resulting fluid-filled HLA does not have undesired "sponginess" and the HLA can provide its protective function on first use. As explained further below, the RPMs are also selected for functions such as check element motion or plunger motion.

Another alternative design may configure the paddles to function also as fluid containers. The paddles of this configuration would hold both the HLAs and the desired fluid. A drum may be included as a safety mechanism, a collection mechanism, or as a further fluid container. When used as a fluid container, the paddles may be lowered in to the fluid to replenish the fluid surrounding the HLA and then the paddles may be spun raised out of the fluid or, as illustrated, the paddles may be spun while submerged in the fluid. This submerged alternative may require the drum 602 to spin with the paddles 605, or may require accommodations for fluid splatter.

In yet another alternative, the paddles may be fixed at a stationary angle so the paddles do not swing while spinning, thereby maintaining a fixed angle during rotation of the paddles. For example, a conical structure may have appropriately sized slots set at an angle such as 45 Degrees. The HLAs may be loaded in to the slots and the structure may be mechanically coupled to the motor to rotate.

It is to be understood that while reference to the HLA of FIG. 1 has been made with respect to FIGS. 5A-6B, other HLAs may be used, including the HLAs of FIGS. 2 and 3 and various HLAs of the types broadly referenced in FIGS. 4A-4E, as well as any device of similar construction that needs to be filled with fluid to function properly.

Figure 7:
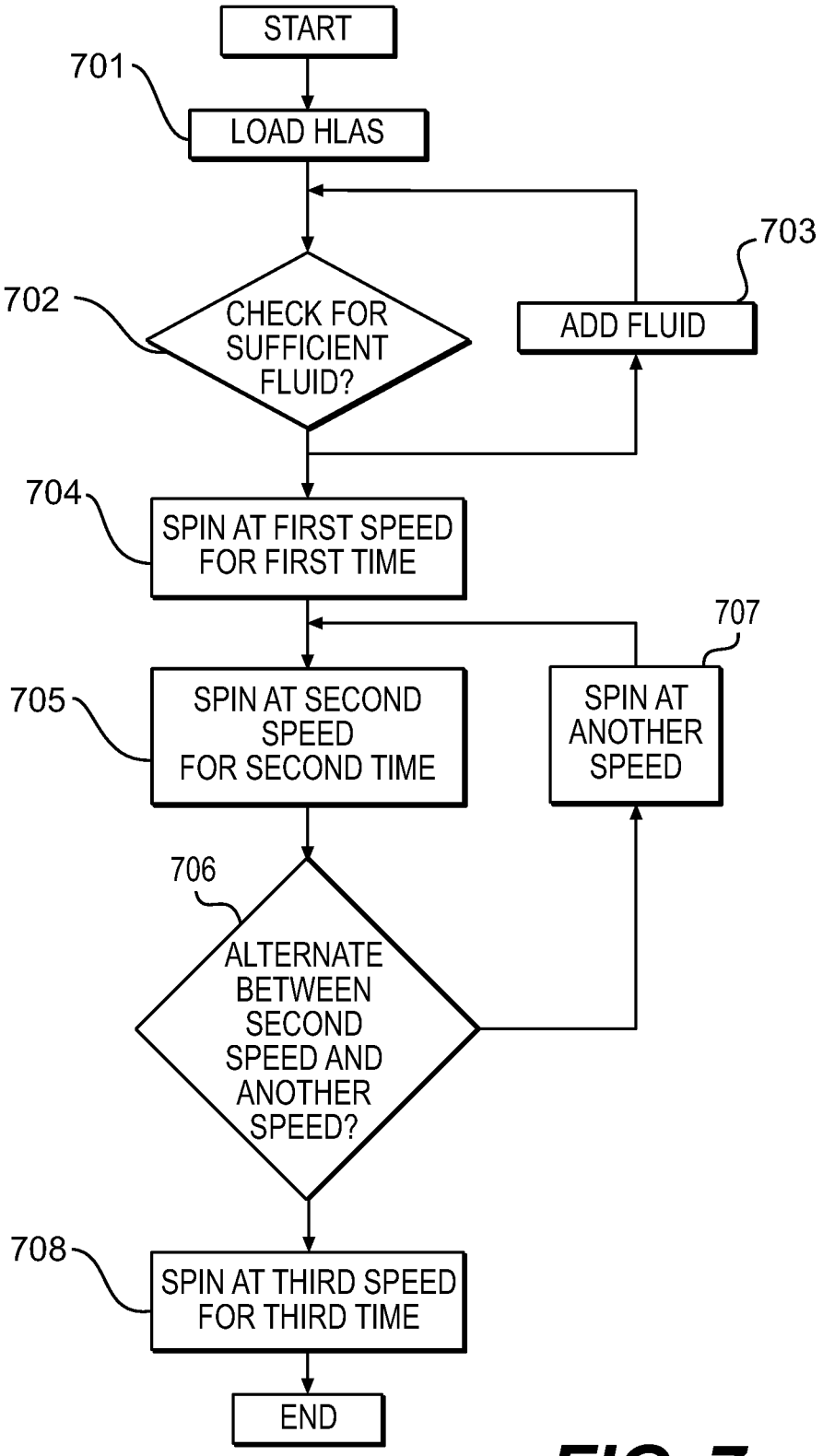
FIG. 7 is a flow diagram of a method.

Turning now to exemplary methods for filling the HLAs with a desired fluid to eliminate air, FIG. 7 shows a first method using the exemplary device of FIGS. 5A and 5B. In step 701, one or more HLAs are loaded in to the drum 502 of the centrifuge. The HLAs can be organized in trays before being loaded in to the drum 502. The HLAs are oriented so that movable parts within the HLA can move once sufficient centrifugal force is achieved. For example, the HLA of FIG.

1 has its long axis oriented toward the center point of the drum 502. That is, the HLA 11 has, with respect to FIG. 1, its bottom seated nearest the drum wall and its opening 27 facing the center point of drum 502.

Once the HLAs are loaded, in step 702, the fluid level is checked manually or via one or more sensors to ensure sufficient fluid covers the HLA. The fluid level may be checked prior to loading the HLAs, with fluid addition before or after loading the HLAs, though FIG. 7 shows the fluid check and addition after the HLAs are loaded.

The fluid may cover the HLA entirely or be at a level to cover only fluid entry points such as body fluid port 28, plunger fluid port 29, and opening 27. The fluid level is preferably sufficient to cover the entire HLA prior to and after spinning, though an alternative method may have the fluid cover the entire HLA only during actual drum spinning, when the fluid will move up the walls of the drum due to centrifugal forces. Covering the entire HLA with fluid allows the fluid to enter crevices between parts such as cap 25 and plunger 15, which encourages fluid transfer into crevices between body 13 and plunger 15, among others. Covering at least the entry points of the HLA, or covering the entire HLA also enables a pumping or stroking action, described below, to suction fluid in to the device.

If sufficient fluid is present, the method proceeds to step 704, otherwise, to step 703 to add fluid and then back to step 702 to recheck for sufficient fluid. In step 704, the centrifuge may be spun at a first speed for a predetermined time to force fluid into the second fluid chamber 23. Since the check-ball of FIG. 1 is normally-biased open, the fluid can freely flow in to the second fluid chamber 23. Fluid may enter the HLA through opening 27 and flow in to first fluid chamber 21. At times, a metering valve pin may be present in opening 27 and may restrict fluid flow there through. So, fluid may also enter body fluid port 28 and plunger fluid port 29, if aligned.

When using a normally-biased closed HLA, such as the examples shown in FIGS. 2 and 3, the first speed is sufficient to overcome the spring forces on the check ball and bias the check ball 49 or 324, respectively, in to an open position. It is preferable to come up to the first speed gradually, and to avoid jerking the HLA. The HLAs may be spun for a sufficient period of time to fill the second, high pressure chamber.

It may be advantageous to proceed to step 705 and spin the drum at a second speed that bottoms out the plunger 15. The step can cause alignment of the body fluid port 28 and plunger fluid port 29, if they are not previously aligned. The step allows for further fluid motion into the fluid chambers within the HLA, such as the low pressure, first fluid chamber 21 or 321. In addition, the action of bottoming-out may agitate fluid transfer. The second speed should be sufficient to force the desired fluid in to the HLA and preferably break any air into small and easily dispersed bubbles. The force of the fluid at this speed should expel air from the HLA chambers. The step may also allow for further fluid motion into the crevices within the HLA, such as leakdown crevices that may be present between the plunger 15 and body 13, or fluid passageway 320 or switching fluid passageway 329.

The method may include a step 706 to determine if it is beneficial to alternately spin the drum at the second speed and another speed. In step 707, the spinning at another speed may take place, and the another speed may be equal to, less than, or more than, the first speed. The another speed is selected to allow the plunger to rise up, and then the drum is returned to the second speed to re-bottom the plunger. The alternation may continue until the HLA is fully pumped up.

A final spinning step 708 may be advantageous to ensure full fluid packing of the HLA 11. That is, it is possible that passageways such as leakdown crevices between the plunger 15 and body 13 have not yet been fully filled with the desired fluid. This final spinning step 708 would ensure the HLA is fully filled.

When the fluid transfer in to the HLA 11 is complete, the centrifuge can stop spinning and the HLAs may be unloaded. If the fluid level sufficiently covers all fluid entry points on the HLA, the fluid may prevent re-entry of air as the plunger 15 moves from the bottomed-out position to its normal at-rest position.

If normally-biased closed HLA 12 of FIG. 2 is used in the centrifuge of FIGS. 5A and 5B, the first spinning step 704 is sufficient to unseat the check ball 49 and open the fluid passageway between first fluid chamber 21 and second fluid chamber 23. Fluid may transfer as above. Second spinning step 705 would bottom-out plunger 15, and third spinning step 706 would allow fluid packing of the HLA 12, as above. The another speed may be used, as above, to alternately raise and lower the plunger 15.

Figure 8:
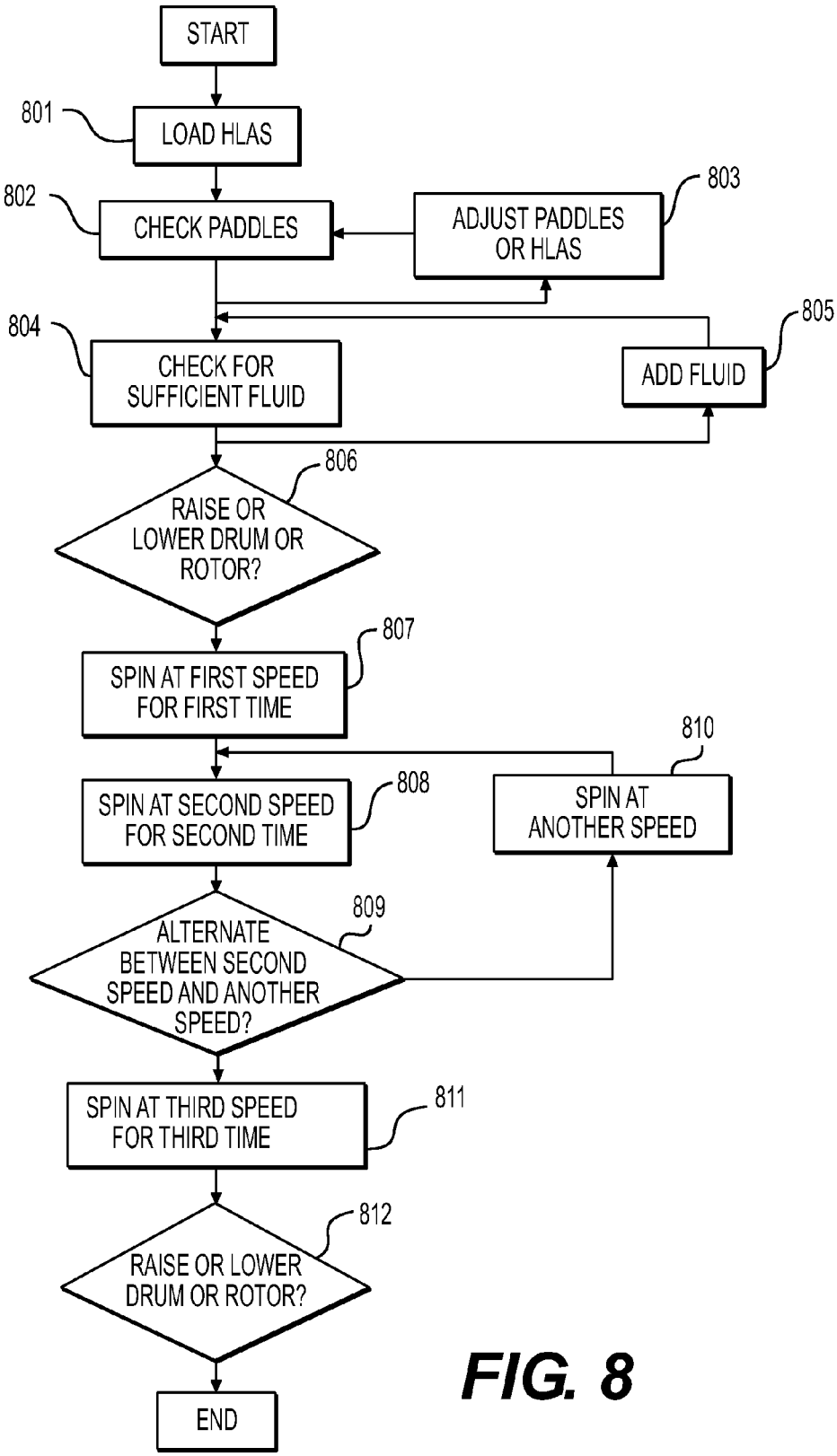
FIG. 8 is another flow diagram of a method.

Turning to FIG. 8, a flow-diagram shows steps for an alternative method for using the centrifuge of FIGS. 6A and 6B. Step 801 would entail loading HLAs or a combination of ballast weights and HLAs in to the paddles 605. Step 802 includes a check to ensure the paddles are mounted and balanced correctly in the centrifuge. Step 802 may include mounting the paddles, if the paddles are detached from the centrifuge for loading and unloading of HLAs. If the check results are good, the method proceeds to step 804, otherwise, the paddles, HLAs, or ballast weights are adjusted, as needed, in step 803. The method returns to step 802 to check the paddles for appropriate distribution of weight and for correct mounting of the paddles.

Proceeding to step 804, the fluid level is checked, similar to step 702 above, to ensure sufficient fluid is in the centrifuge. A fluid addition step 805 is included if the fluid level must be adjusted. However, the centrifuge of FIGS. 6A and 6B has additional operational considerations in step 806. As above, the drum 602 may be raised, or the rotor 604 may be lowered, to adequately cover the HLAs with fluid. The raising and lowering may be prior to, or contemporaneous with, the spinning steps to ensure appropriate fluid distribution.

Similar to the method of FIG. 7, the HLAs are aligned in the paddles to allow centrifugal forces to assist with fluid exchange so that the desired fluid enters the HLA and any air present is expelled. The example of FIGS. 6A and 6B shows that as paddles 605 spin, the long axis of the exemplary HLA goes from perpendicular to a central axis of the centrifuge to parallel to the central axis. For the illustrated HLA, opening 27 spins from an upward-facing position to an inward-facing position to facilitate fluid 603 motion in to first fluid chamber 21 and second fluid chamber 23.

Also similar to FIG. 7, the spinning steps 807, 808, 810 and 811 are performed at sufficient speeds for sufficient time to expel any air present in the HLA and force fluid 603 in to the HLA. A first spinning step 807 spins the paddles 605 a sufficient speed and time to unseat check elements, if present, and allow fluid to push in to second fluid chamber 23. A second spinning step 808 bottoms-out the plunger 15, and a third spinning step 811 fully fluid packs the crevices and fluid pathways of the HLA. The method of FIG. 8 may also include a query in step 809 to determine if it is desirable to alternate between the second speed and another speed, and the method may further include spinning at another speed in step 810 to raise the plunger while forcing in desired fluid.

When the HLAs are sufficiently fluid-filled with the desired fluid, the spinning ceases and the paddles drop. If the rotor 604 or drum 602 were raised or lowered in step 806, then in step 812, the reverse action is taken to return the drum 602 and rotor 604 to a position adequate to unload. The HLAs may then be unloaded, or, if so designed, the collar 609 and paddles 605 may be removed or exchanged for a new set up.

In addition to the centrifuge devices shown in FIGS. 5A-5B, the methods may be used with centrifuges such as fixed-angle centrifuges that are designed to hold the sample containers at a constant angle, such as 45, 60, 70 or 90 degrees. For example, a vertical fixed-angle centrifuge may hold the long axis of the illustrated HLA vertically and may allow fluid to force in through the body fluid port 28 and plunger fluid port 29 and air may be expelled upward out of the metering valve opening.

In addition, other swinging head (or swinging bucket) centrifuges than that illustrated in FIGS. 6A and 6B may be used. Other head or bucket designs may be implemented to have a hinge where the HLA containers are attached to a central rotor, or a collar on the central rotor, to allow the HLAs to swing outwards as the centrifuge is spun.

Other purpose built machines not necessarily classified as centrifuges can also be used for this same purpose provided the machine has the common function of developing variable centripetal force along the HLA longitudinal axis.

Lastly regarding the methods of FIGS. 7 and 8, certain HLA designs may require the number of spinning steps to change, or may result in the intended function of the step to adjust. For example, a single speed may bottom out the plunger at the same time any check element is unseated, thereby eliminating a spinning step. Or, as another example, the HLA may become fully fluid packed contemporaneous with one of the unseating or bottoming-out steps. The transition between speeds may be stepwise or a continuous sweep along a range of speeds.

The centrifugal methods disclosed herein are particularly beneficial to the field of HLA fluid filling. The centrifugal method avoids traditional methods that place extreme mechanical pressure on the HLA, such as when a mechanism is used to force the plunger up and down. The centrifugal method also avoids the need to mechanically move the check element out of the way to fill the second fluid chamber. This latter benefit is particularly useful for HLAs such as the one shown in FIG. 3, where direct access to the check ball 324 is obscured by other HLA parts. By selecting appropriate spinning speeds, the HLA can be fluid-filled without placing excessive strain on the device.

As one working example, using the fully assembled HLA 312 of FIG. 3, the HLA 312 may be loaded in to a centrifuge according to step 701 or 801 and prepared as described above for spinning at first speed 704 or 807. The first speed includes a G level of about 85 Gs and the centrifugal force on the check ball 324 overcomes the check ball spring 318. The high G level pushes the oil down, collapsing the air in to small bubbles and forcing air out of the HLA 312 via fluid ports 322, 327, 331, clearances between parts, leakdown passages, etc. So, a hypothetical one cubic millimeter (1 mm^3) air bubble in a stationary HLA has about 0.0044N trying to push the air out as oil comes in, but at 85 G, the same air bubble has about 0.37N pushing the air out.

The second speed 705 or 808 may be around 750 RPM or 192 G to bottom the plunger 315. As the plunger moves down, fluid is pushed in to the second high pressure chamber 323, which forces air upwards in to the first low pressure chamber 321. The hypothetical one cubic millimeter air bubble has a force of about 0.84N pushing it out. Alternating at another speed in steps 707 or 810 may further agitate the HLA for air transfer out of the HLA, both by pushing fluid down with the plunger 315 and by sucking fluid in as the plunger rises. An additional high speed third spinning step 708 or 811 could exert additional force on the oil and fully or substantially expel any remaining air.

Figure 9:
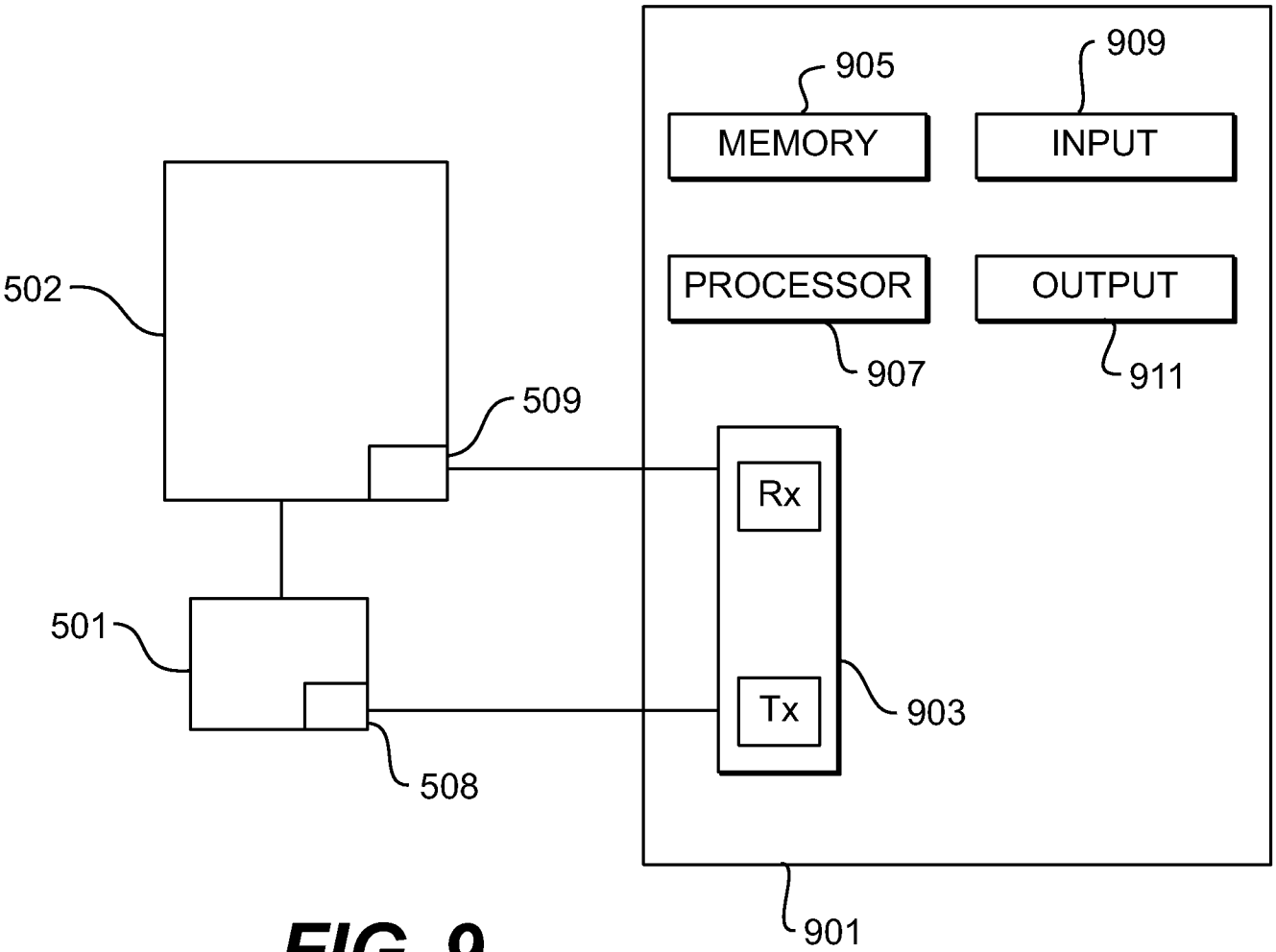
FIG. 9 is an example of a control system for use with a centrifuge for implementation of the disclosed methods.

Turning to FIG. 9, a schematic shows a control system for implementing the methods of FIGS. 7 and 8. A computing control device 901 may comprise one or more memory device 905, such as RAM, ROM, disc, hard drive, or EPROM devices that tangibly store an algorithm or other instructions or programming. One or more processor 907 can access the algorithm, instructions or programming via communication means such as bus and read mechanisms. The processor 907 can also access data stored on the memory device 905. Data and programming may be displayed, transmitted, printed or otherwise output via output 911, which can comprise devices such as cable ports, screens, tactile feedback mechanisms, etc.

Users can input new data, programming, commands or other inputs at input 909. Examples of data stored or input include HLA information such as size (dimensions), weights, spring constants, and fluid type information such as viscosity and mass. The input 909 may comprise devices such as cable ports, screens, keyboards, mouse, synaptic pad, etc.

The computing device 901 may also include a transceiver device 903 with transmit (TX) and receive (RX) capabilities. The transceiver device 903 may alternatively be separate transmit and receive devices with communication means therebetween.

The computing device 901 has appropriate wiring and other electrical connectivity to transfer signals such as data and commands.

The computing device 901 may be integral with or separate from the centrifuge apparatus. In either implementation, computing device 901 communicates with structures on the centrifuge to control the speed of the motor and the duration of time that the rotor or drum of the centrifuge spins. FIG. 9 shows the device of FIGS. 5A and 5B, but another centrifuge structure may be used.

Sensors 509 are configured to communicate with the computing device to indicate such things as drum 502 speed, balance, and fluid level. When used with the structure of FIGS. 6A and 6B, the sensors may additionally collect data to determine whether the paddles are full and balanced within the centrifuge. Examples of suitable sensors include optical sensors, mass sensors, and force sensors. They may be located as needed on the centrifuge.

Motor 501 may also include motor communication means 508, which may include speed sensors and control means. The motor 501 may thereby receive instructions for controlling the motor speed, such as RPMs, and duration of speed. The communication means 508 may also include sensors to enable the ability to determine if the desired speed has been achieved.

In the preceding specification, various examples have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

For example, in addition to the broad categories of FIGS. 4A-4E, HLAs used with the method and devices may be of several cartridge types, including normally-biased open, normally-biased closed, or "free ball." Examples of compatible HLAs include those disclosed in U.S. Pat. Nos. 6,941,915, 6,325,034, and 5,855,191, incorporated herein by reference in their entirety.

Other embodiments will be apparent to those skilled in the art from consideration of the specification and practice of the disclosure. It is intended that the specification and examples be considered as exemplary only, with the true scope and spirit of the invention being indicated by the following claims.

We claim:

1. A method for adding fluid to an hydraulic lash adjuster (HLA), the HLA comprising: a housing, a first fluid chamber, a second fluid chamber, a fluid passageway between the first fluid chamber and the second fluid chamber, and at least one fluid port in fluid communication with the first fluid chamber, the method comprising:

placing the HLA in to a centrifuge, the centrifuge having a fluid container;

placing an amount of a first fluid in the fluid container to fluidly communicate with the at least one fluid port; and spinning the HLA at a first speed sufficient to move the first fluid in to the second fluid chamber.

2. The method of claim 1, wherein the HLA further comprises a check element in a check valve, wherein the check valve comprises the fluid passageway, and wherein the check element is selectively movable in a cage to open and close the fluid passageway, the method further comprising spinning the HLA at a speed sufficient to maintain the check element in an open position.

3. The method of claim 1, wherein the HLA further comprises a plunger, and wherein the plunger is a spring-loaded plunger in a top-biased position and the plunger is movable to a bottomed-out position, the method further comprising spinning the HLA at a second speed sufficient to move the plunger from the top-biased position to the bottomed-out position.

4. The method of claim 3, further comprising spinning the HLA at a third speed.

5. The method of claim 3, further comprising alternating between spinning the HLA at another speed sufficient to return the plunger to its top-biased position, and spinning the HLA at the second speed.

6. The method of claim 5, further comprising spinning the HLA at a third speed.

7. The method of claim 1, wherein the amount of the first fluid is sufficient to communicate with the at least one fluid port when the HLA is not spinning.

8. The method of claim 1, wherein the amount of the first fluid is sufficient to communicate with the at least one fluid port when the HLA is spinning at the first speed.

9. The method of claim 1, wherein the first fluid is of sufficient density to displace a second fluid out of the first fluid chamber and out of the second fluid chamber.

10. The method of claim 1, wherein the centrifuge comprises a motor operatively connected to a drum, and the HLA spins when the drum of the centrifuge is spun by the motor.

11. The method of claim 1, wherein the centrifuge comprises a motor operatively connected to a rotor, and paddles operatively coupled to the rotor, and wherein the HLA spins when the paddles are operatively spun by the motor.

12. The method of claim 11, wherein the centrifuge comprises a drum to hold the first fluid, and mechanisms to lower and raise the paddles in the drum, and wherein the method further comprises lowering the paddles in the drum.

13. The method of claim 12, wherein the lowering step is contemporaneous with the spinning step.

14. The method of claim 11, wherein the centrifuge comprises a drum to hold the first fluid, and mechanisms to lower and raise the drum with respect to the paddles in the drum, and wherein the method further comprises raising the drum with respect to the paddles.

15. The method of claim 14, wherein the step of raising the drum is contemporaneous with the spinning step.

16. The method of claim 1, wherein the HLA further comprises a plunger, and wherein the fluid port is in the housing and the plunger further comprises at least one plunger fluid port in fluid communication with the fluid port.

17. The method of claim 1, wherein the HLA further comprises a plunger, and wherein the plunger further comprises a metering valve opening in fluid communication with the first fluid chamber and the method further comprises placing a sufficient amount of the first fluid in the fluid container to fluidly communicate with the metering valve opening.

18. The method of claim 1, wherein the fluid port is in the housing, wherein the HLA further comprises an inner sleeve, wherein the HLA further comprises a plunger, wherein at least one of the plunger and the inner sleeve comprises a port for fluid communication with the fluid port, wherein the plunger and sleeve are spring-loaded in a top-biased position and the plunger and the sleeve are movable to a bottomed-out position, and wherein the method further comprises spinning the HLA at a second speed sufficient to move the plunger and the sleeve from the top-biased position to the bottomed-out position.

19. The method of claim 18, further comprising the step of alternating between spinning the HLA at another speed sufficient to return the plunger and the sleeve to the top-biased position, and spinning the HLA at the second speed.

20. The method of claim 1, further comprising the step of ceasing the spinning step, wherein the first fluid fluidly communicates with the at least one fluid port when the HLA is spinning and when the spinning step has ceased.

* * * * *